US005848830A

United States Patent [19]

Castle et al.

[11] Patent Number: 5,848,830

[45] Date of Patent: Dec. 15, 1998

[54] ILLUMINATED FLOOR MAT ADVERTISER

[76] Inventors: Peter L. Castle, 95 Trailwood Drive, Suite 1032, Mississauga, Ontario, Canada, L4Z 3L2; Edward Turon, 2001 Bonnymede Drive, Condo Unit #194, Mississauga, Ontario, Canada, L5J 4H8

[21] Appl. No.: 645,195

[22] Filed: May 13, 1996

[51] Int. Cl.[6] ..... F21V 33/00

[52] U.S. Cl. ..... 362/84; 362/253; 362/276; 362/802; 362/806

[58] Field of Search ..... 362/153, 253, 362/276, 802, 103, 84, 806, 310, 267

[56] References Cited

U.S. PATENT DOCUMENTS 5,019,950 5/1991 Johnson et al. ..... 362/802

*Primary Examiner*—Thomas M. Sember
*Attorney, Agent, or Firm*—Edward Turon

[57] ABSTRACT

A floor mat having a transparent first sheet overlaid upon a second sheet and sealed about a perimeter edge to define a pocket for receiving an advertisement. A water resistant releasable closure is associated with the first and second sheets to facilitate access to the pocket. Further embodiments provide an electro-luminescent lamp and/or an audio emitter being disposed within the pocket.

4 Claims, 6 Drawing Sheets

ILLUMINATED FLOOR MAT ADVERTISER

FIELD OF THE INVENTION

This invention relates to floor coverings and in particular to a floor mat for presenting advertising information to a consumer.

BACKGROUND OF THE INVENTION

It is common for advertisers to present advertisements in strategic locations to maximize exposure of their advertisements to consumers. Traditional forms of advertising such as billboards and posters are now being located in strategic areas such as bus shelters, walls of interior transit vehicles, public washroom walls and the like. These strategic locations take advantage of areas where consumers are likely to direct their eyes and focus their attention.

One area that is underused for the presentation of advertising media is the ground or floor area of commercial establishments and public concourses. It is common for people to look down at the ground regularly while walking or standing in public areas (e.g. elevators). While it is known to inlay or tape advertising panels onto the floor space of some large-scale shopping areas, this semi-permanent installation tends to be intrusive and costly.

What is needed is a low cost way to present advertising media on a floor area.

SUMMARY OF THE INVENTION

In one aspect, the present invention provides a floor mat comprising:

a substantially transparent first sheet overlaid upon a second sheet and sealed about an edge to define a pocket; and a light source disposed within said pocket for illuminating an advertisement, said light source being electrically connected to a power source.

In a second aspect, the present invention provides a method for advertising on a floor space comprising the steps of:

accessing a floor mat having a substantially transparent first sheet overlaid upon a second sheet and sealed about a perimeter edge to define a pocket;

inserting an advertising substrate within said pocket so that the advertisement is visible through said substantially transparent first sheet;

inserting a light source in said pocket for illuminating said advertising substrate, said light source being electrically connected to a power source, and said substrate being at least partially translucent; and positioning said floor mat in a desired location on a floor surface.

Advantageously, the mat presents advertising media on a floor location so that it is frequently observed by consumers. At the same time, the mat functions as a regular floor mat by protecting the floor and preventing customers from slipping on slippery surfaces. In further aspects of the invention, the mat is provided with advertising enhancements, such as backlighting and audio.

DETAILED DESCRIPTION OF THE PREFERRED EMBODIMENT

Figure 1:
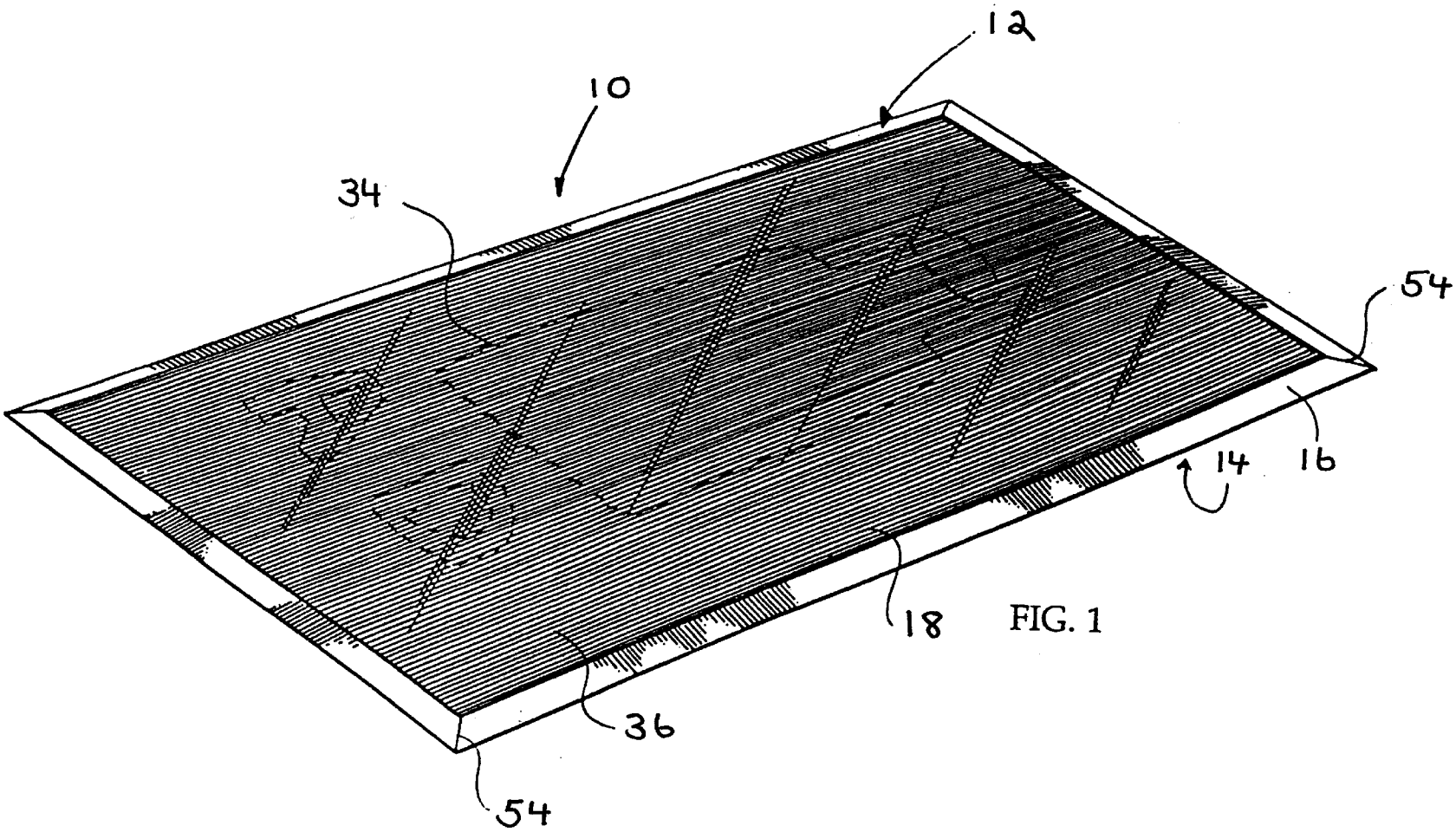
FIG. 1 is a perspective view of a floor mat in accordance with the present invention.
Figure 2:
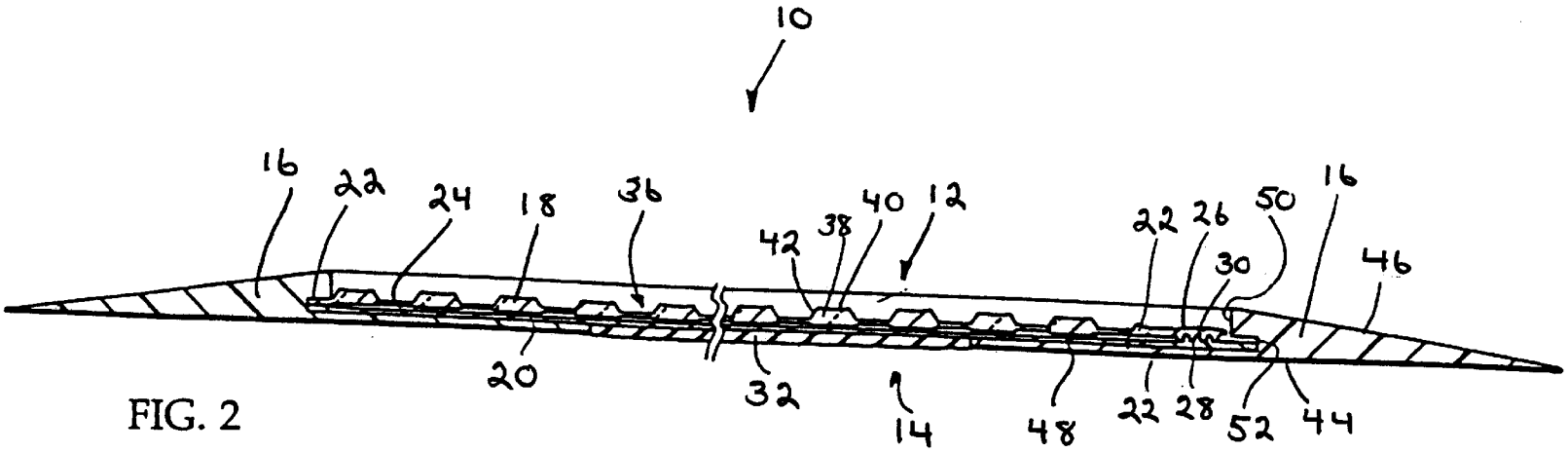
FIG. 2 is a partial sectional view of the floor mat of FIG. 1 taken along lines 2—2.

Referring to FIGS. 1 to 9, a floor mat or floor covering in accordance with the present invention is depicted generally at 10. The floor mat 10 is intended to occupy an area of floor space in a commercial establishment where it is desirable to present advertising media to a customer. The mat 10 could also be used privately, by a home owner for instance, to display artwork or photographs in a unique manner.

The floor mat 10 has a top surface 12, a bottom surface 14 and a border 16. The top surface 12 of the mat 10 is substantially covered by a first sheet 18 of a substantially transparent durable, water resistant material such as PVC plastic. The first sheet 18 overlays a thin second sheet 20 of PVC plastic or the like to define at least one substantially water resistant pocket 24 between the sheets 18, 20. The first and second sheets 18, 20 are connected together along a perimeter edge 22 with a radio frequency seal, heat seal, tape, glue, clamps, rivets, staples, stitches or other adhesion means for producing a substantially water resistant seal.

Figure 3:
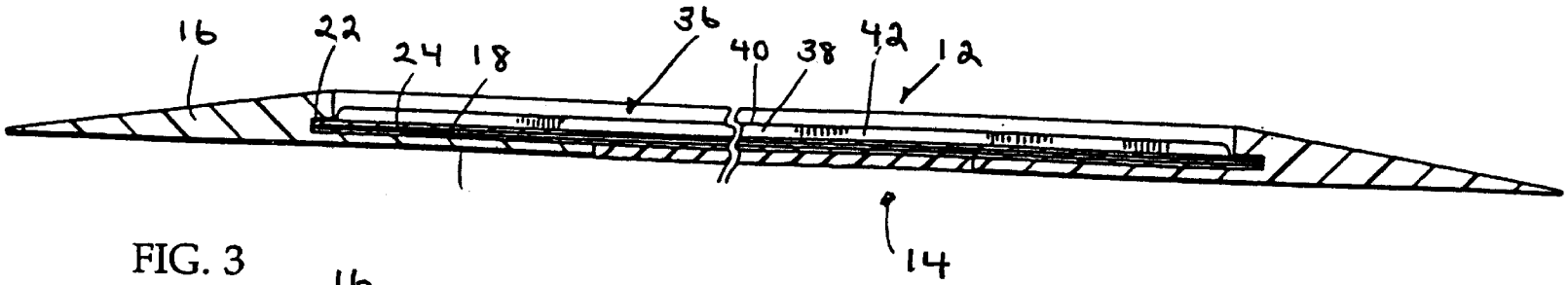
FIG. 3 is a partial sectional view of the floor mat of FIG. 1 taken along lines 3—3.

A releasable closure 26 is located on the first and second sheets 18, 20 to releasably close access to the pocket 24. The closure 26 is preferably substantially water resistant to protect the contents of the pocket 24 from becoming spoiled. Referring to FIG. 3, it can be seen that the closure 26 is preferably formed from corresponding strips 27 of PVC plastic with tongues 28 and grooves 30 that interconnect similar to a ZIPLOC™ closure 26. The closure 26 is commercially available under the trade mark FLEXTITE. The strips 27 are connected to the first and second sheets 18, 20 by a radio-frequency seal, heat seal, tape, glue or other suitable adhesion means. Alternative releasable closures 26 are also contemplated such as hook and loop fasteners, overlapping edges, or metal or plastic zippers.

The bottom surface 14 of the mat 10 is substantially covered by a third sheet 32 that is fastened by glue, tape, rivets, plugs or other suitable adhesion means to the bottom of the second sheet 20. The third sheet 32 is formed from a material that resists sliding against smooth floor surfaces and also provides a cushion effect. Preferably the third sheet 32 is formed of an open cell rubber sponge material. Alternately (or additionally), the mat 10 may be more permanently secured to the floor with fasteners such as screws, nails, bolts, two-sided tape, VELCRO™ or glue.

The pocket 24 of the mat 10 is sized to receive an advertising substrate 34 such as one or more posters. The substrate 34 may be polystyrene, mylar, plastic or any other suitable substrate for an advertisement. The substrate 34 is preferably translucent to facilitate backlighting as described below. The advertisement may be applied to the substrate 34 in many known ways, including lithography, silk screening, lenticular printing and painting. Furthermore, the advertisement may be applied to the substrate 34 in known manner to create a 3-dimensional effect depending on the position of the customer or the direction of the backlighting. The advertising substrate 34 is installed through the releasable opening in the mat 10 and may be changed as often as desired.

The top surface 12 of the mat 10 includes a tread 36 to prevent pooling of water or other substances that may cause an individual to slip on the mat 10. The preferred tread 36 configuration comprises a plurality of spaced ridges 38 that extend longitudinally along the mat 10. As shown in FIG. 3, the ridges 38 have a top surface 40 that is generally planar and oriented parallel to the top surface 40. The ridges 38 also include side walls 42 that are inclined at a steep angle downwardly and outwardly relative to the top surface 40. It has been found that the rear perpendicular side walls 42 and flat top surface 40 of the ridges 38 minimizes distortion of the visual image viewed through the first surface of the mat 10.

The border 16 of the mat 10 is formed from elongate extruded strips of a durable plastic material such as PVC plastic. The border 16 has a flat bottom surface 44 and an inclined top surface 46 that extends downwardly and outwardly relative to the bottom surface 44. The bottom surface 44 is wider than the top surface 46 and defines a flange 48 for supporting the edge of the first and second sheets 18, 20. A vertical face 50 extends between the top of the flange 48 to the top surface 46. A slot 52 is defined in the vertical face 50 for receiving the perimeter edges 22 of the first and second sheets 18, 20. The border 16 may be secured to the first and second sheets 18, 20 by glue, tape or other appropriate sealing means disposed between the top of the flange 48 and the bottom of the second sheet 20. Each end 54 of the border 16 may be angled in known manner to define a square corner for the mat 10. A portion of the border 16 may include a slot 55 on the bottom surface 44 to provide clearance for electrical wiring or the like as described below.

Figure 5:
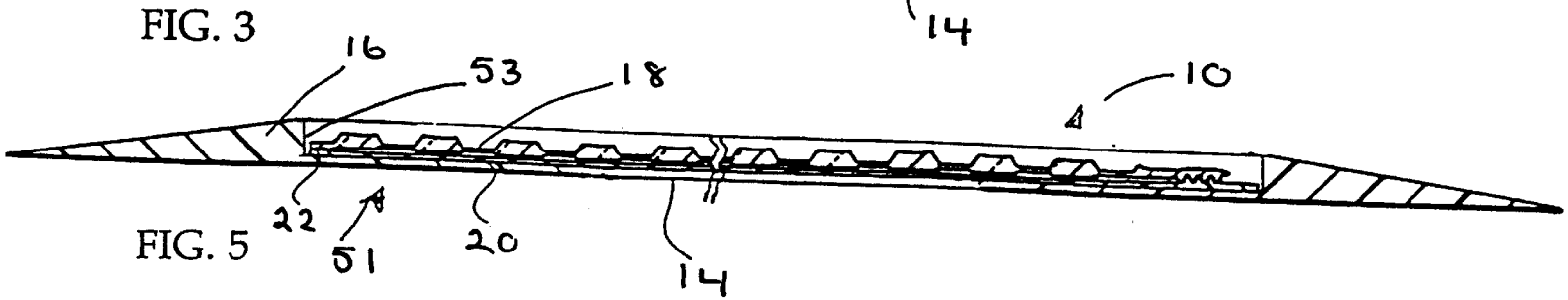
FIG. 5 is a transverse sectional view of a modified arrangement of the floor mat of FIG. 1.
Figure 4:
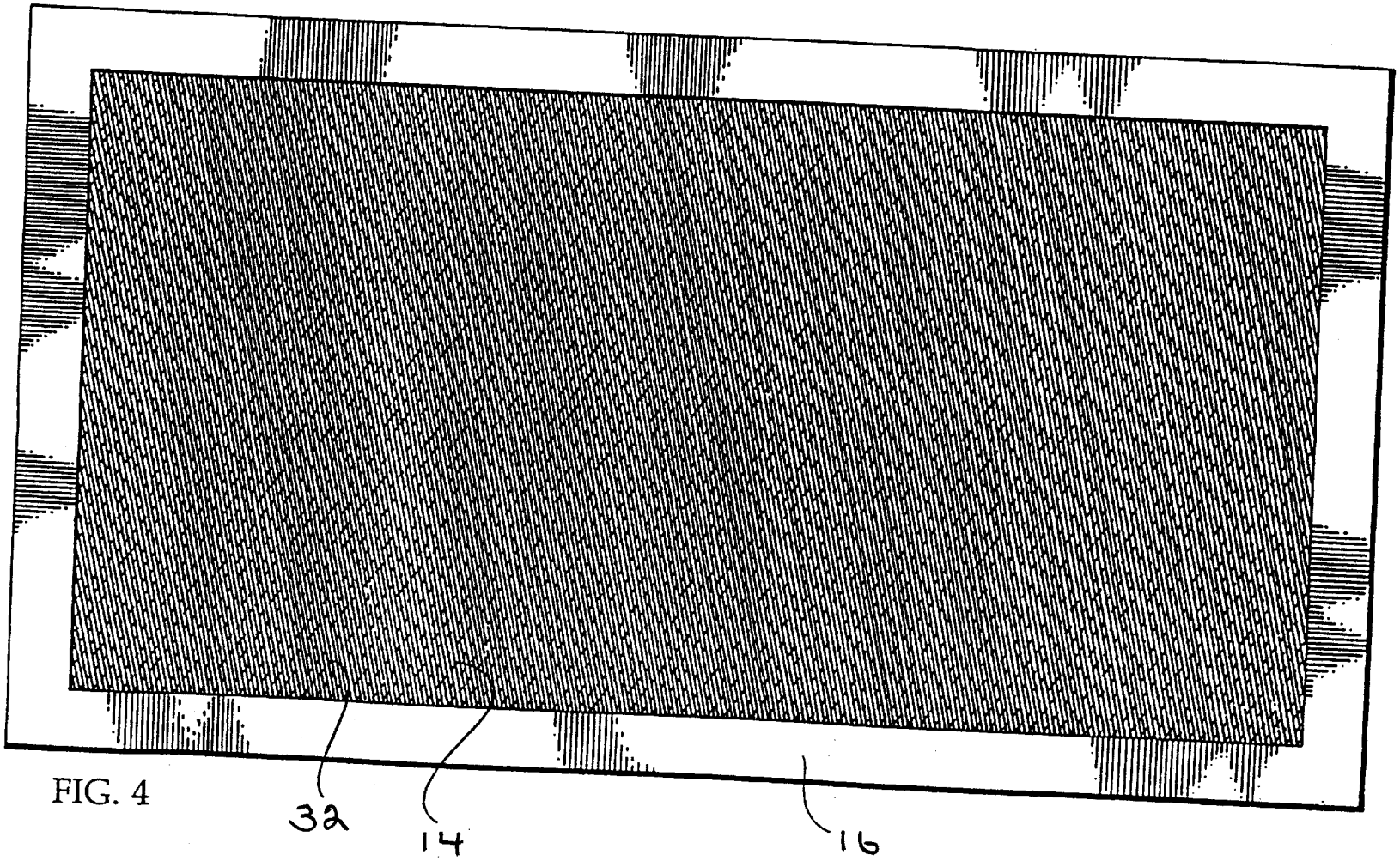
FIG. 4 is a bottom view of the floor mat of FIG. 1.
Figure 6:
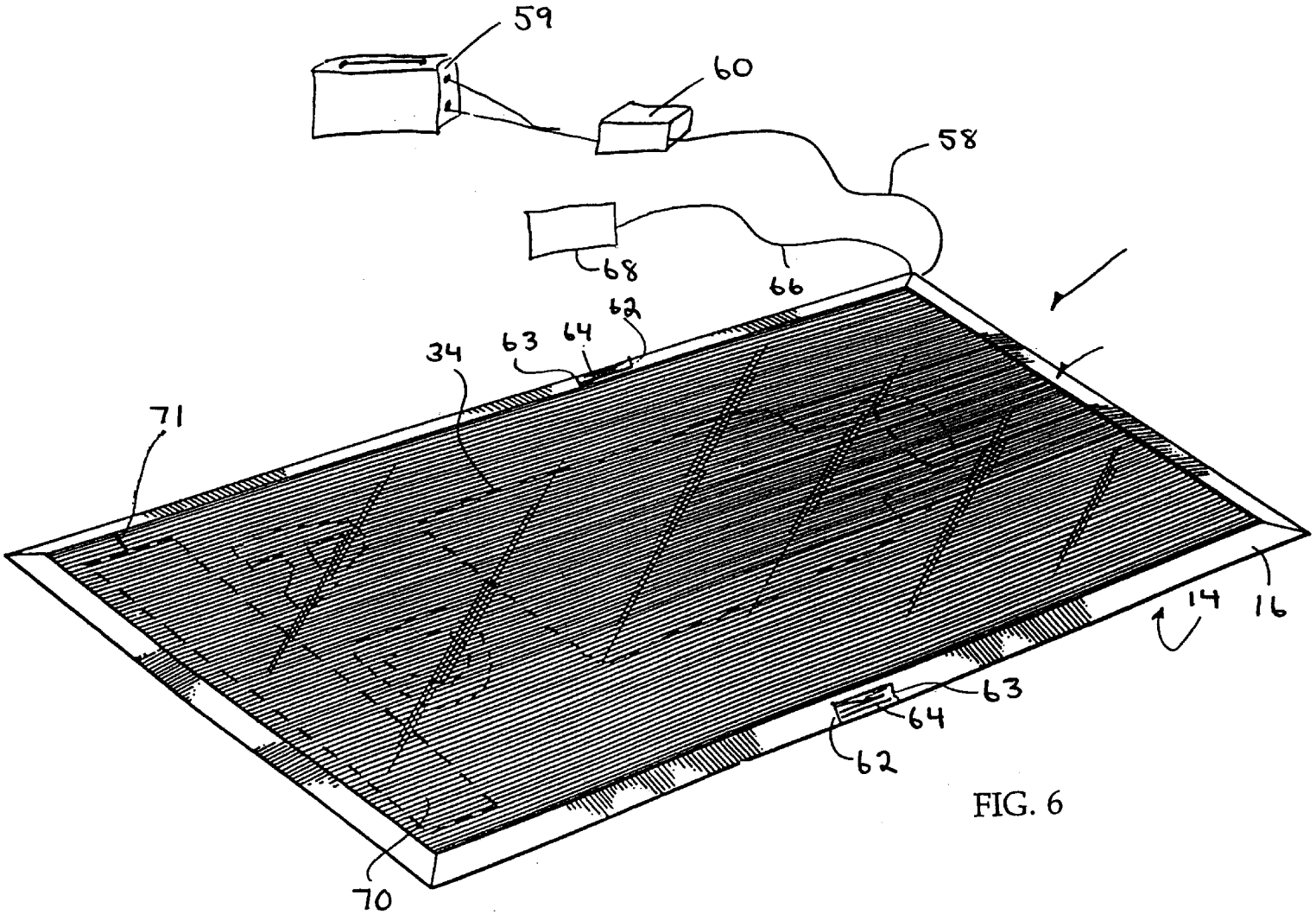
FIG. 6 is a perspective view of a second embodiment of the floor mat in accordance with the present invention.
Figure 7:
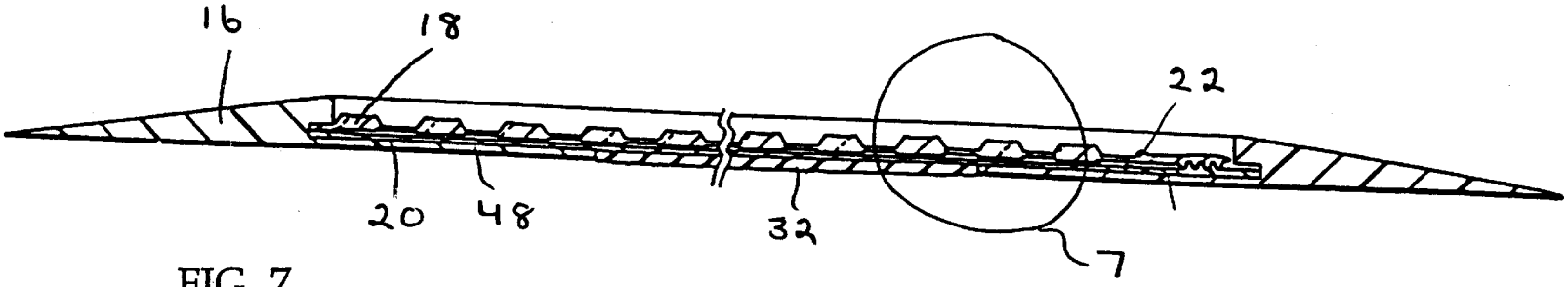
FIG. 7 is a partial sectional view of the floor mat of FIG. 6 taken along lines 6—6.
Figure 8:
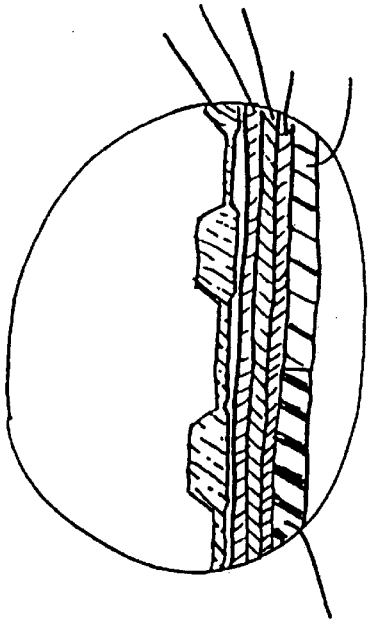
FIG. 8 is an enlarged sectional view of the floor mat of FIG. 7.
Figure 9:
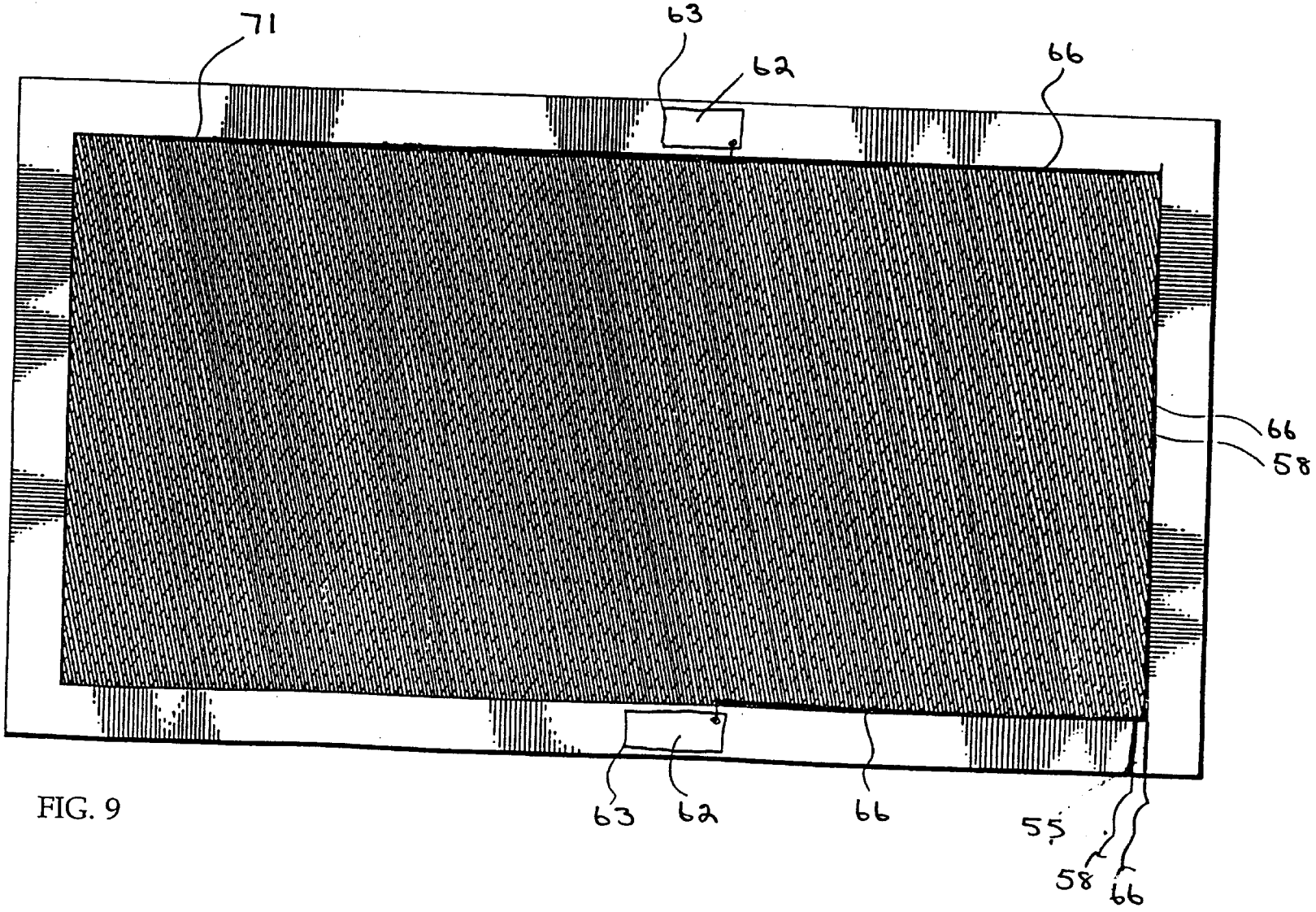
FIG. 9 is a bottom view of the floor mat of FIG. 6.

A modified arrangement for the border 16 and bottom surface 14 of the mat 10 is depicted in FIG. 5. The modified arrangement provides a one-piece base 51 formed of a durable rubber or plastic material. A central recess 53 is defined in the top of the base for receiving the first and second sheets 18, 20 that have previously been adhered together to form the pocket. The sheets 18, 20 are adhered to the surface of the recess 53 in the same manner for adhering the third sheet 32 as described above. The perimeter of the recess 53 defines the border 16 having a profile that slopes downwardly and outwardly to facilitate a relatively flush interface between the edge of the mat 10 and the floor (to deter someone from tripping on the mat 10). The bottom of the base would include rubber strips or other means to resist sliding of the mat relative to the floor as described above. It has been found that this modified arrangement will reduce the overall costs for manufacturing the mat.

A second embodiment of the mat 10 is depicted in FIGS. 6 to 9. For convenience, the same reference numbers are used to refer to corresponding elements of the first mat embodiment depicted in FIGS. 1 to 5.

The second embodiment of the mat 10 is modified to include a light source 56 for illuminating the advertising material 34 that is disposed within the pocket 24. The preferred light source 56 is a conventional electro-luminescent lamp that is disposed within the pocket 24 beneath the advertisement to backlight the advertisement 34 as desired. The electro-luminescent lamp 56 may be made into whatever size is desired for illuminating the advertisement 34. In the embodiment depicted, the lamp 56 covers a substantial portion of the surface area of the mat 10. Electro-luminescent lamps are preferred because of their thin profile and durability. It has been found that the lamp can withstand the wear and tear associated with customers walking on the floor mat containing the lamp 56.

The electro-luminescent lamp 56 is electrically connected by a conductor 58 to a power source 59. The power source 59 may either be an electrical outlet or a battery. An inverter 60 may be utilized to convert between AC and DC power for operating the electro-luminescent lamp 56. Further modifications may be added to the lamp 56 such as a timed switch (not shown) to cause the lamp 56 to blink at a desired interval.

The electro-luminescent lamp 56 is a lossy, light emitting compacitor. The two most widely used types of electro-luminescent lamps are "foil" and "polymer thick film". The "foil" lamps use a thin aluminum foil base layer and the "polymer thick film" lamps use a conductive silver ink pad. In each case, the lamps are constructed with a laminant incorporating a front lead, bus bar, transparent front electrode, phosphorescent dielectric, rear electrode and rear lead. The lamps require an alternating current, although they may be operated with a DC-AC invertor. When applied, the current creates a potential between the front and rear electrodes, which excites the phosphor causing it to fluoresce light.

The second embodiment of the mat 10 also includes an audio emitter. The audio emitter includes a speaker 62 that is disposed in a recess 63 beneath a grill 64 that is defined in the border 16 of the mat 10. The speaker 62 may be connected by speaker wires 66 to an external audio source 68 for playing the desired audio sounds. Alternatively, a chip (not shown) containing the desired sounds may be disposed with the speaker 62 in the border 16 of the mat 10. The chip may be replaced as desired with a different chip according to a different advertisement that is exposed within the pocket 24 of the mat 10. The audible sounds emitted from the speaker 62 might include a jingle or other appropriate sound associated with the visual advertisement.

The mat 10 also includes a touch sensitive pad 70 disposed within the pocket 24 that actuates the speaker 62 or the lamp 56 (or both) when someone walks on the mat 10. The pad 70 is connected to the power source 59 and to the lamp 56 or audio emitter (or both) by wires 71. Alternatively, the speaker 62 or lamp 56 may be actuated by a photocell or an external means for sensing when an individual is in the vicinity of the mat 10.

For both the first and second embodiments of the floor mat 10, the mat is preferably sufficiently flexible so that it may be rolled for storage or transport. The electro-luminescent lamp 56 is sufficiently flexible that it may be rolled with the mat 10.

It is to be understood that what has been described is a preferred embodiment to the invention. If the invention nonetheless is susceptible to certain changes and alternative embodiments fully comprehended by the spirit of the invention as described above, and the scope of the claims set out below.

We claim:

1. A floor mat comprising:

a substantially transparent first sheet overlaid upon a second sheet and sealed about an edge to define a pocket;

a electro-luminescent lamp disposed within said pocket for illuminating an advertisement, said light source being electrically connected to a power source; and sensing means associated with said mat for actuating said light source when an individual is walking upon said mat.

2. A floor mat as claimed in claim 1, wherein said sensing means comprises a touch sensitive switch disposed in said pocket.

3. A method for advertising on a floor space comprising the steps of:

accessing a floor mat having a substantially transparent first sheet overlaid upon a second sheet and sealed about a perimeter edge to define a pocket;

inserting an advertising substrate within said pocket so that the advertisement is visible through said substantially transparent first sheet;

inserting a light source in said pocket for illuminating said advertising substrate, said light source being electrically connected to a power source, and said substrate being at least partially translucent; and positioning said floor mat in a desired location on a floor surface.

4. A method as claimed in claim 3, wherein said light source comprises an electro-luminescent lamp.

* * * * *